United States Patent [19]

Schurmeier

[11] Patent Number: 4,615,471

[45] Date of Patent: Oct. 7, 1986

[54] REFRACTORY PLATE AND METHOD FOR REINFORCING

[75] Inventor: Gustave B. Schurmeier, Houston, Tex.

[73] Assignee: M. H. Detrich, Itasca, Ill.

[21] Appl. No.: 746,446

[22] Filed: Jun. 19, 1985

[51] Int. Cl.[4] ..... B22D 41/08

[52] U.S. Cl. ..... 222/598; 222/600; 228/173.5

[58] Field of Search ..... 222/591, 598, 599, 600, 222/590; 266/236, 271; 29/505, 447; 164/438, 337; 228/173.5, 178, 182

[56] References Cited

U.S. PATENT DOCUMENTS

| | | | |
|---|---|---|---|
| 1,982,852 | 12/1934 | Bergstrom et al. | 29/447 |
| 3,712,518 | 1/1973 | Meier | 222/561 |
| 4,141,478 | 2/1979 | Meier | 222/600 |
| 4,182,466 | 1/1980 | Fehling et al. | 222/600 |
| 4,265,379 | 5/1981 | Meier | 222/600 |
| 4,474,362 | 10/1984 | King | 266/236 |
| 4,480,881 | 11/1984 | Meier | 222/598 |
| 4,508,241 | 4/1985 | Bauer et al. | 222/600 |
| 4,508,324 | 4/1985 | Lührsen et al. | 222/600 X |
| 4,531,271 | 7/1985 | Lechner et al. | 228/191 X |
| 4,566,925 | 1/1986 | Schnabel et al. | 222/600 X |

FOREIGN PATENT DOCUMENTS

| | | | |
|---|---|---|---|
| 616108 | 7/1978 | U.S.S.R. | 228/173.5 |

*Primary Examiner*—Joseph J. Rolla
*Assistant Examiner*—Nils Pedersen
*Attorney, Agent, or Firm*—Wood, Dalton, Phillips, Mason & Rowe

[57] ABSTRACT

A refractory member adapted for use in a casting vessel valve is disclosed including a refractory plate, a wire helically wound around the periphery of the plate, and means rigidly interconnecting the helical windings to one another. A method is also disclosed for reinforcing a valve plate, including the steps of heating a metal wire into a malleable state, securing one end of the wire with respect to the plate, helically winding the heated wire about the plate with the windings substantially abutting one another, and welding together each wire winding with the abutting windings at at least one spot. An apparatus for performing the method is also disclosed, including a rotatable support for supporting the plate with its periphery exposed, a drive for rotating the supported plate, a jig assembly orienting the supported plate in a position generally tangent to the reinforcing wire, and preheat burners for heating the wire to a malleable state before winding about the plate.

17 Claims, 9 Drawing Figures

FIG. 1
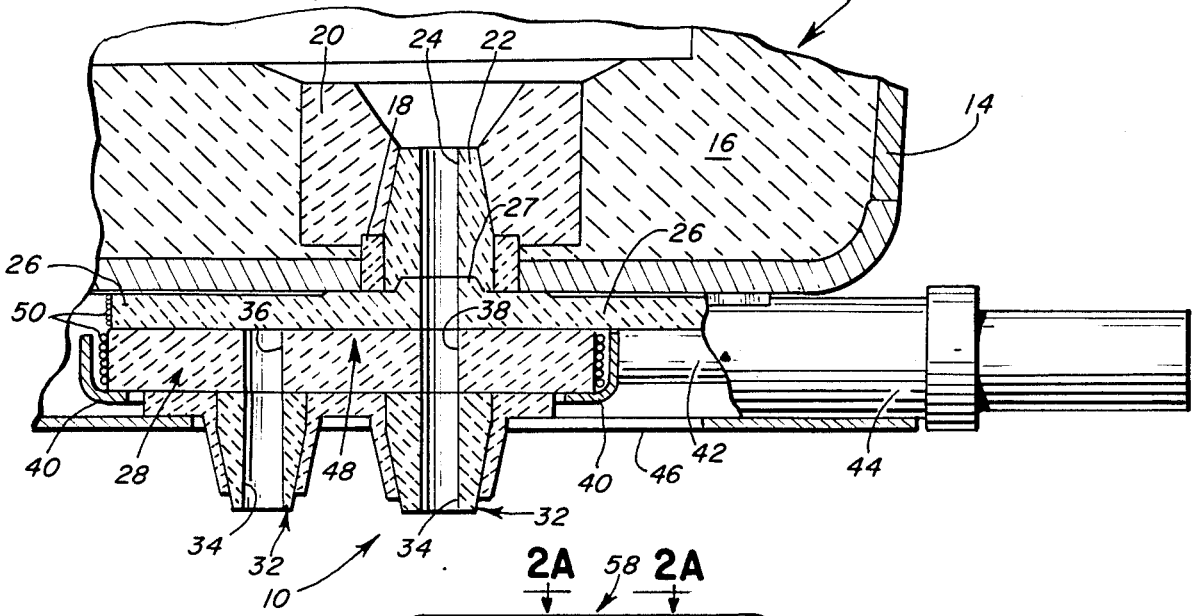
FIG. 2
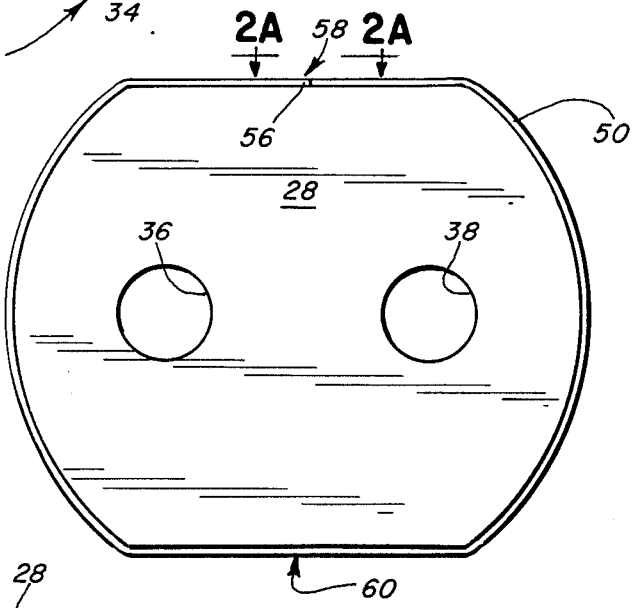
FIG. 2A
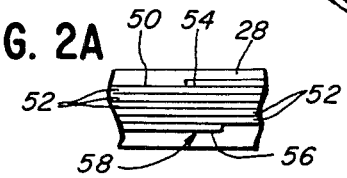
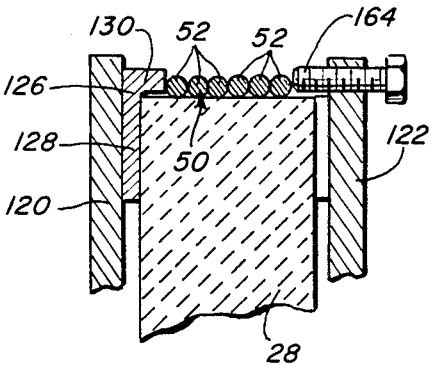
FIG. 6
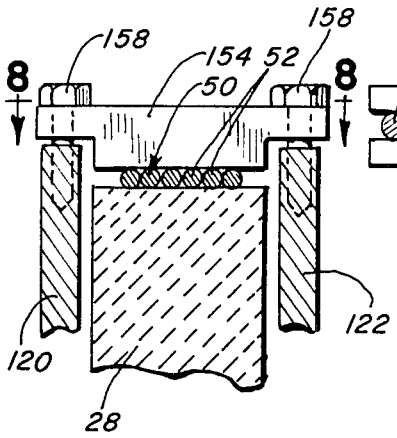
FIG. 7
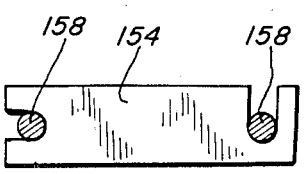
FIG. 8

FIG. 3
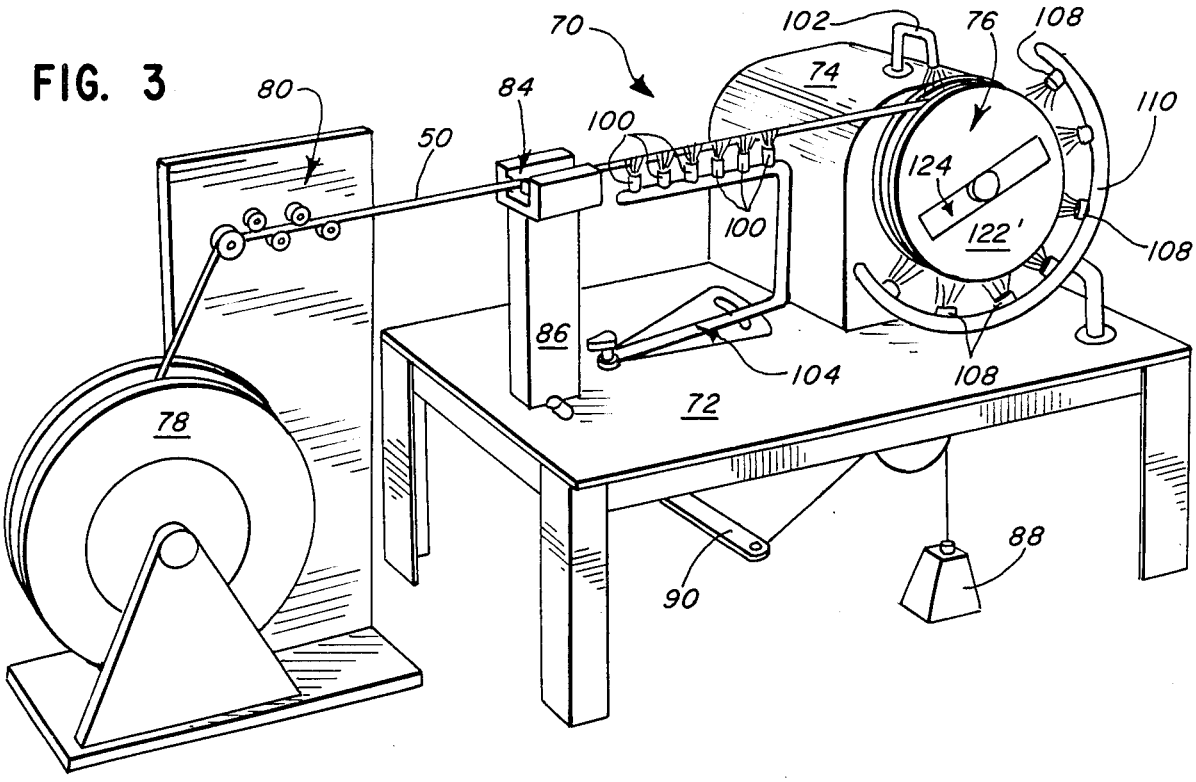
FIG. 4
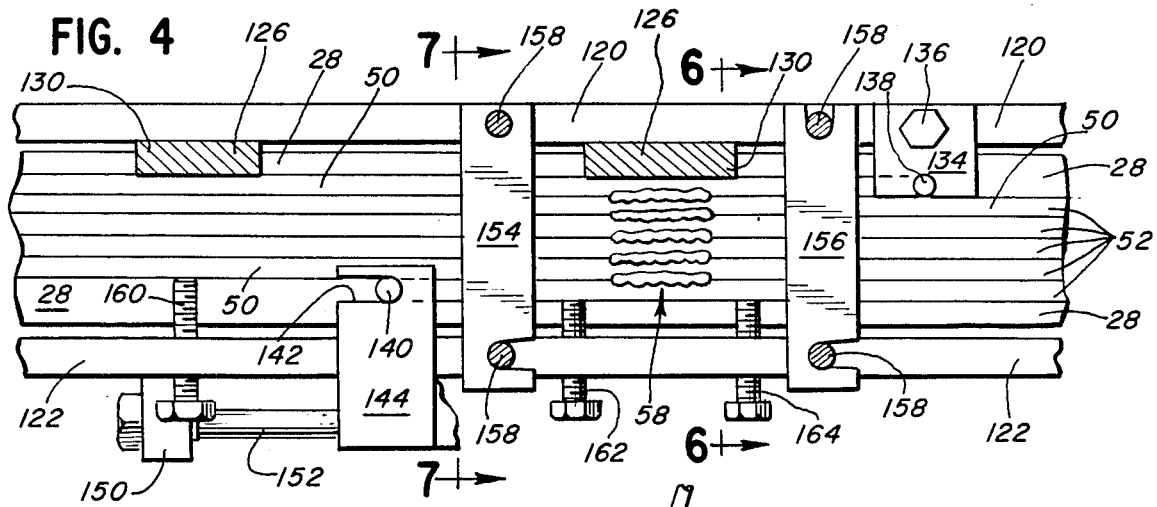
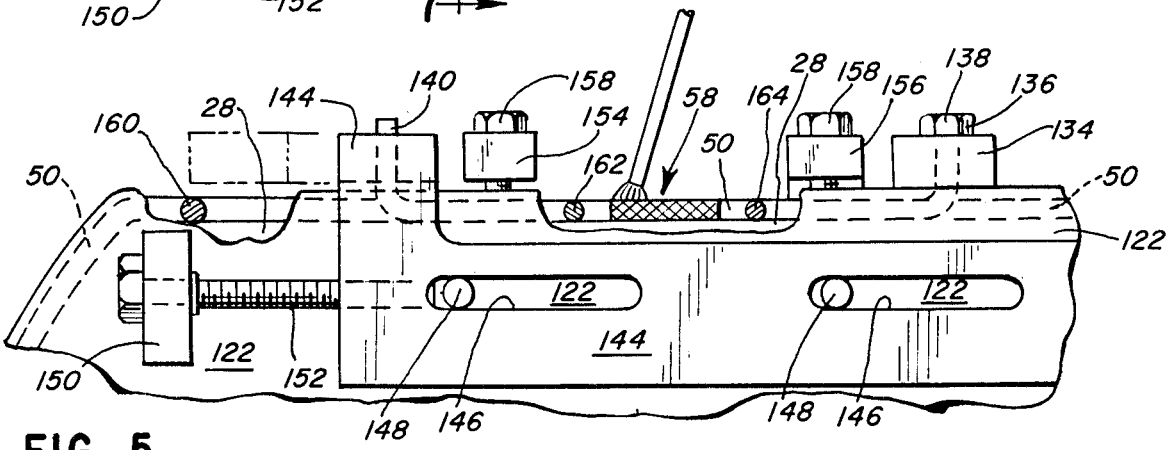
FIG. 5

REFRACTORY PLATE AND METHOD FOR REINFORCING

DESCRIPTION

Background of the Invention

1. Technical Field

The present invention relates to a valve for a casting vessel, and in particular to the reinforcement of the reciprocating plate used in casting vessel valves.

2. Background Art

Casting vessels within which molten metal may be placed for transportation and distribution are known in the art. A gate or valve is commonly located in a lower portion of the vessel to allow molten metal to be poured from the vessel, as for example into a mold for making a part. Such valves typically include a refractory plate made of suitable ceramic material and having an opening therethrough which may, be linear or rotary reciprocation, be aligned with a similar opening in a fixed plate of the vessel to open the valve.

Because of the extreme temperatures to which the refractory plates are subjected (e.g. molten steel is around 3000° F., molten copper is around 1900°–2300° F., and molten aluminum is around 1200°–1400° F.), the plates are subject to cracking as a result of thermal shock. As a result, in order to maintain the structural integrity of the plate, suitable reinforcement must be provided. It has been found however that the reinforcement cannot have point bearings on the plate as this will shatter the plate.

One reinforcing structure which has been used is to place the plate in a "can" with the rim of the "can" around the outer edge of the plate. This reinforcing structure is however difficult to fit precisely around the plate and different "cans" must be made for each different size plate. Further, mortar is required to fit each plate in the reinforcing "can", and the mortar is compressed and susceptible to cracking itself when the plate expands under the high temperature conditions. Also, since the reinforcing "can" is on one side of the plate as well as around its edge, plates reinforced by "canning" cannot be turned over.

It is desirable that the slide plate be capable of being turned over since this enables the service life of the plate to be extended. That is, the extreme temperatures to which the plate is subjected cause excessive wear about the plate opening on its upper side so that each opening can usually be subjected to only one heat. By turning the plate over, each opening can be subjected to a second heat to effectively double its useful life. However, cracking due to thermal shock occurring when the plate is removed during changeover is inevitable (e.g. a plate used in pouring steel will quickly drop from about 2200° F. to 500° F. when removed from the valve), and thus plate reinforcement is absolutely necessary if the plate is to be reused.

Shrink pipe sections are one reinforcing structure which has been used and which allow the plate to be turned over to extend its useful life. One problem with this reinforcing structure however is that, since individual plates are not manufactured to precise design dimensions even when made in the same mold, there are variations in size between each plate which cannot be readily accommodated by uniform pipe sections. Thus, the shrunk pipe section is at times either too tight or not tight enough. Another problem with this structure is that it is difficult to conform the pipe section to the plate outer edge, with the result being that shims are often required to hold the reinforcing pipe section in place. A further problem with this structure is that the pipe section reinforcing is difficult to properly center between sides of the plate. Yet another problem is that different sizes of pipe sections must be manufactured for each size of plate, with both the circumference and the axial length of the required pipe section depending on the size of the plate to be reinforced. Yet another problem with this reinforcing structure is that failure of the pipe section for any reason will result in the plate being virtually unreinforced, therefore preventing any reuse since it will crack apart when removed from the valve.

Another reinforcing structure which has been used and which also permits the plate to be turned over is to spirally wrap a thin band or strip around the plate and itself approximately four times and then spot weld the end of the band onto the lower windings. This structure is however difficult to wind with any amount of tension since the inner end of the band is covered by the subsequent windings. Another problem with this structure is that a failure of the spot weld will cause the band to pop open and provide no reinforcing for the plate. Yet another problem with this reinforcing structure is that different width bands must be obtained for reinforcing different thickness plates.

The present invention is directed toward overcoming one or more of the problems as set forth above.

SUMMARY OF THE INVENTION

In one aspect of the present invention, a refractory member adapted for use in a casting vessel valve is disclosed including a refractory plate, a wire helically wound around the periphery of the plate, and means rigidly interconnecting the helical windings to one another.

In another aspect of the present invention, a method is disclosed for reinforcing a plate used in a casting vessel valve, including the steps of heating a metal wire into a malleable state, securing one end of the wire with respect to the plate, helically winding the heated wire about the plate with the windings substantially abutting one another, and welding together each wire winding with the abutting windings at at least one spot.

It is one object of the present invention to provide a suitably reinforced refractory plate which may be simply and easily manufactured without requiring specially sized materials to conform to each different size plate. Another object of the present invention is to provide a reinforcing structure which even upon partial failure will continue to provide satisfactory reinforcement. Yet another object of the present invention is to provide a reinforcing structure which conforms to the outer periphery of the plate being reinforced so as to provide an intimate contact therewith at all points about the plate periphery notwithstanding any variations in the plate size from its precise design size. It is still another object of the present invention to provide a reinforcing structure for a refractory plate which will enable the plate to be turned over to maximize its useful life.

BRIEF DESCRIPTION OF THE DRAWINGS

FIG. 1 is a simplified partial cross-sectional view of an exemplary casting vessel valve;

FIG. 2 is a top view of a refractory plate reinforced according to the present invention;

FIG. 2A is a view taken along line 2A—2A of FIG. 2;

FIG. 3 is a perspective view of an apparatus for reinforcing a refractory plate;

FIG. 4 is a partial view of a jig assembly used in the manufacture of a plate reinforced according to the present invention;

FIG. 5 is a partially broken away side view of the apparatus of FIG. 4;

FIGS. 6 and 7 are cross-sectional views taken along lines 6—6 and 7—7 respectively in FIG. 4; and FIG. 8 is a cross-sectional view taken along line 8—8 of FIG. 7.

DESCRIPTION OF THE PREFERRED EMBODIMENT

An exemplary gate or valve 10 with which the reinforced plates of the present invention may be used is illustrated in simplified form in FIG. 1. The valve 10 is disposed in a lower portion of a casting vessel 12 having an outer casing 14 and an inner refractory liner 16 for holding, moving and pouring molten metal.

Secured to the vessel casing 14 is a guide sleeve 18 which centers and holds a pocket block 20 of the valve 10. A nozzle 22 is centered within the pocket block 20 and has a center opening 24 therethrough for pouring molten metal through the valve 10. A fixed bottom plate 26 with a boss 27 is suitably secured to the nozzle 22, as by cementing. The bottom plate 26 is reinforced according to the present invention.

A slide plate 28 also reinforced according to the present invention is slidably disposed against the bottom plate 26. Supported on the opposite side of the slide plate 28 for reciprocation therewith are suitable collector nozzles 32 with central openings 34 therethrough.

The slide plate 28 has two openings 36,38 therethrough aligned with the collector nozzle openings 34. The plate 28 is suitably secured to a collar 40 or the like secured to the rod 42 of a cylinder 44 supported on the valve housing 46. The valve housing 46 is preferably openable by pivoting to allow access for changing the plate 28 and other components as necessary. The cylinder 44 may thus be actuated to reciprocate the slide plate 28 to align one of its two openings 36,38 with the nozzle opening 24 to pour molten metal through the valve 10, or to align the solid part 48 of the slide plate 28 with the nozzle opening 24 to close the valve 10.

It should be understood that the above-described valve is merely exemplary, and that plates reinforced according to the present invention could be used in other casting vessel valves, including rotary systems such as shown in U.S. Pat. No. 4,480,771, and Tundish (three plate) systems, as well as other linear reciprocating systems. Thus, it should further be understood that the references hereafter to the slide plate 28 would apply as well to the fixed plate 26, rotary plates, and other plates which are similarly used to open and close casting vessel valves.

One common metal which is placed in casting vessels 12 such as shown in FIG. 1 is molten steel which is at about 3000° F. and which thus heats the slide plate 28 to that temperature around the opening and generally heats the plate overall of around 2300° F. The valves may also be used with other molten metals as well, such as copper (at about 1900°-2300° F.) and aluminum (at about 1200°-1400° F.). At these elevated temperatures, the slide plate 28 is worn away as it moves to close the valve 10 so that a gap will develop between the slide plate 28 and the ladle nozzle bottom plate portion 26 around the openings 24,36,38 therethrough. As a result of this wear, the slide plate 28 can usually be used only a few times before it must be discarded.

One way to effectively double the useful life of the slide plates 28 is to turn them over and reuse them with the opposite side of the slide plate 28 against the ladle nozzle bottom plate portion 26. In order to do this however, the slide plate 28 must be removed from the valve 10 and, during this maintenance, thermal shock (resulting from a quick temperature drop from, for example, 2300°-500° F.) will crack the plate 28. As a result, the slide plate 28 must be suitably reinforced to maintain its structural integrity so that it may be reused.

A slide plate 28 reinforced according to the present invention is shown in FIG. 2. The plate 28 is manufactured in a suitable manner such as by molding, firing and sanding, and is made of a suitable refractory material. Any number of materials may be used, including zirconium, magnesium oxide, 90% alumina content ceramic and combinations of zirconium, aluminum and carbon. The plate 28 is also usually tar impregnated and then baked to turn the tar into carbon which acts as a lubricant on the plate 28.

After the plate 28 has been suitably manufactured such as described above, it may be reinforced according to the present invention as hereinafter described. The plate reinforcing consists of a wire 50 (e.g. a steel wire) helically wound about the plate 28 with each coil or winding 52 (see FIG. 2A) substantially abutting the adjacent windings. The number of windings 52 used in the reinforcing may be varied according to the dimensions of the particular plate being reinforced. As is more fully described hereafter, the wire 50 is wound about the plate 28 in a malleable state and in tension. Preferably its two ends 54,56 overlap slightly (as shown in FIG. 2A) with the ends 54,56 and adjacent windings 52 in that area 58 suitably welded together. The windings 52 are also preferably welded together in the area 60 opposite the wire ends 54,56 (see FIG. 2).

An apparatus 70 adapted to reinforce a slide plate 28 according to the present invention is shown in FIG. 3. The apparatus 70 includes a table 72 supporting a drive mechanism 74 for rotating a plate 28 (not seen in FIG. 3) to be reinforced.

A suitable jig assembly 76 mounts the plate 28 to the drive mechanism 74 and maintains the plate 28 in a proper orientation during rotation. As shown in FIG. 3, the jig assembly 76 is adapted to simply turn a circular plate for reinforcing. Where non-circular plates are to be reinforced, the drive mechanism and jig assembly preferably should rotate the mounted plate in a nonconcentric manner so that the wire 50 being fed onto the plate will substantially maintain its axial orientation (i.e. so that the plate tangent point will be maintained along a fixed wire axis as the plate rotates).

A dispensing roll 78 for the wire 50 used in reinforcing the plate 28 is located adjacent the table 72. A suitable wire straightener 80 is located adjacent the dispensing roll 78 to straighten the wire 50 so that it is essentially fed to the apparatus 70 in a linear configuration.

It has been found that low carbon, hot rolled steel wire such as used in making coil springs is suitable for reinforcing slide plates 28, though still other materials could also be used, including extruded steel, drawn steel and any number of suitable alloys. The particular size of the wire 50 can be varied though it has been found that wire diameters just below diameters classified by the steel industry as rod size, such as a ¼ inch diameter wire, are suitable. The wire 50 may also be a cable formed of a number of finer wire strands. Use of large diameter wires is advantageous in that fewer windings are usually required, thereby minimizing manufacturing time and also minimizing the total surface area subject to oxidation during storage of the reinforced plate 28 prior to use.

The wire extends through a pair of tension jaws 84 which through a suitable mechanism 86 are caused to frictionally engage the wire 50 so as to tension the wire 50 as it is drawn around the plate 28 by the drive mechanism 74. The mechanism illustrated in FIG. 3 includes a weight 88 which biases a lever 90 suitably connected to the jaws 84 through a suitable mechanism (not shown) to bias the jaws 84 together by constant force. Of course, any number of other suitable tensioning mechanisms could also be used.

Suitable preheat burners 100 and a winding burner 102 are provided to heat the wire 50 to place it in a malleable condition to ensure that the wire 50 may be easily conformed to the outer edge of the plate 28. The preheat burners 100 shown are of a gas flame type which, when steel wire for example is used, will bring the wire to around 1200° F. to make it malleable. The winding burner 102 is an oxy-propylene torch which can further heat the wire 50 to about 1800° F.

A suitable aligning structure 104 is provided with the preheat burners 100 to allow the burners 100 to move with the wire 50 as it shifts laterally during the helical winding.

Post winding burners 108 are also provided on an arcuate support 110 located about the plate 28 being reinforced to prevent the wire 50 from cooling during winding. The plate 28 is at ambient temperature during winding, with its outer edge only indirectly heated by the hot wire 50 and the burners 102,108.

Since the wire 50 when it cools will contract but otherwise maintain its shape, it is desirable to maintain the wire 50 at an elevated temperature until the wire ends 54,56 are secured. This is particularly important where the plate 28 is not circular such as shown in FIG. 2 since it ensures that the wire bends around the smaller diameter corners of the plate 28 are not caused to shift away from the associated plate corners. It is also desirable to maintain the wire temperature until the wire ends 54,56 are welded so that the contraction of the wire 50 thereafter when cooled will add a pre-tension to the reinforcing in addition to the tension introduced by the tension jaws 84 during winding.

A high frequency hammer (not shown) may also be provided to strike the malleable wire 50 as it is wound about the plate 28 to ensure that the wire 50 conforms to the plate configuration, particularly at corners around the plate 28.

The above-described apparatus 70 thus allows the wire 50 to be easily guided to wrap in a coil about the slide plate 28 with intimate contact at all points around the outer edge of the plate 28.

Once the wire 50 has been suitably wrapped about the plate 28, it may be cut by any suitable means and then the adjacent windings 52 suitably welded, as by electric arc welding, spot welding, or gas welding, at the areas 58,60 before the wire temperature falls below about 700° F. This ensures that the wire windings 52 will have a substantially uniform tension.

The jig assembly 76 which maintains the wire 50 in proper tension and orientation during winding and welding is shown in detail in FIGS. 4–8. The assembly 76 includes a pair of side plates 120,122 secured on opposite sides of the slide plate 28 by a suitable clamp 124 through the plate openings 36,38 (see FIG. 3, in which side plate 122' is adapted for reinforcing a circular plate).

A suitable number of L-shaped base side clamps 126 are located with one leg 128 between one side plate 120 and the slide plate 28 (see FIG. 6) and the other leg 130 projecting over the slide plate 28 edge to provide the desired spacing between the plate side and the first winding 52.

A fixed start clamp 134 is suitably secured to the one side plate 120, as by the bolt 136 shown, and has an opening therein in which a bent end 138 of the wire 50 is located at the beginning of winding.

When winding is thereafter completed, the cut end 140 of the wire 50 is bent into a slot 142 of the moving finish clamp 144. As best shown in FIG. 5, the finish clamp 144 includes a pair of side slots 146 within which are received side plate pins 148. A bolt 152 extending through an ear 150 on the side plate 122 is threadably received within the finish clamp 144. When the bolt 152 is rotated, the finish clamp 144 is drawn toward the ear 150 (as shown in phantom in FIG. 5) to thereby ensure that the wire is properly tensioned during welding.

A suitable backing (not shown) may be provided over the slot 142 if desired so as to ensure that the tension introduced by the finish clamp 144 does not tend to straighten the cut end 140 and release the desired tension.

Additional clamping of the wire 50 after it has been wound about the plate 28 is also provided by a pair of hold down clamps 154,156 secured to the side plates 120,122 (see FIGS. 7 and 8) by suitable bolts 158. These clamps 154,156 hold down the windings 52 against the plate 28 on either side of the area 58 to be welded. Further clamping of the wire 50 is also provided by a number of bolt clamps 160,162,164 extending through the side plate 122. The bolt clamps 160,162,164 ensure that the windings 52 about one another (see in particular FIGS. 4 and 6).

Once the windings 52 are properly positioned and clamped, the abutting windings in area 58 may be suitably welded together as previously discussed. The area 60 on the opposite side of the plate 28 may then also be welded. Hold down and bolt clamps may also be provided for securing the windings 52 at area 60 if desired.

As a final step, the portions of the wire ends 138,140 extending beyond the weld area 58 may then be cut off and discarded.

With the above-described invention, a valve plate may be easily reinforced, and this may be accomplished using the same size reinforcing material for each different size plate. Also, each plate is securely reinforced despite the large manufacturing tolerances which must be allowed for in making refractory plates of any given size. Further, the reinforcing provided by this structure is such that even should there be a partial failure, the coiled wire will nevertheless continue to provide a sufficient reinforcement. Still further, the above-described reinforcing structure allows slide plates 28 to be turned upside down for a second use so that the effective life of such plates 28 may be maximized.

Other aspects, objects and advantages of the present invention can be obtained from a study of the drawings, the specification and the appended claims.

I claim:

1. A reinforced refractory member adapted for use in a casting vessel valve, comprising:

a refractory plate having at least one hole therethrough;

an elongated member helically wound about the periphery of said plate; and means rigidly interconnecting the helical windings to one another.

2. The member of claim 1, wherein at room temperature said elongated member is in tension about said plate.

3. The member of claim 1, wherein said elongated member is a metal wire and said interconnecting means comprises a weld between the helical windings of the wire.

4. The member of claim 3, wherein said wire is low carbon, hot rolled steel.

5. The member of claim 4, wherein said wire has a diameter of $\frac{1}{4}$ inch.

6. The member of claim 1, wherein the elongated member is a cable formed of multiple metal wires.

7. The member of claim 1, wherein the plate is a 90% alumina content ceramic.

8. A method for reinforcing a refractory plate adapted for use in a casting vessel valve, comprising the steps of:

heating an elongated metal member into a malleable state;

securing one end of the member with respect to the plate;

helically winding the heated member around the plate at least twice with the helical windings of the member substantially abutting one another; and welding together each member winding with the abutting windings at at least one spot.

9. The method of claim 8, wherein the welding step is performed across all of the windings at one location.

10. The method of claim 9, wherein the welding step is performed across all of the windings at a second location spaced substantially halfway around the plate from the one location.

11. The method of claim 8, wherein the winding step is accomplished by rotating said refractory plate.

12. The method of claim 11, wherein the member is maintained in tension during the winding step.

13. The method of claim 8, further comprising the step of striking the malleable member to conform it to the plate during the winding step.

14. The method of claim 8, wherein the member is low carbon, hot rolled steel wire and the steel wire is heated during the heating step to at least 1100° F. before winding around the plate.

15. The method of claim 8, wherein the welding step is accomplished while the member is at an elevated temperature.

16. The method of claim 15, wherein the member is low carbon, hot rolled steel wire and has a temperature of at least 600° F. during the welding step.

17. The method of claim 16, wherein the welding step is accomplished by electric arc welding.

* * * * *